US010335804B2

(12) United States Patent
Eberle et al.

(10) Patent No.: US 10,335,804 B2
(45) Date of Patent: Jul. 2, 2019

(54) CENTRIFUGE WITH DAMPING ELEMENTS

(71) Applicant: ANDREAS HETTICH GMBH & CO. KG, Tuttlingen (DE)

(72) Inventors: Klaus-Guenter Eberle, Tuttlingen (DE); Erik Rainer Gerlach, Erfurt (DE); Fritz Walter Bernd Fiedler, Bad Blankenburg (DE); Christoph Pabst, Tuttlingen (DE); Marcellus Geiselmann, Tuttlingen (DE); Armin Brendle, Muehlhausen-Ehingen (DE)

(73) Assignee: ANDREAS HETTICH GMBH & CO. KG, Tuttlingen (DE)

( * ) Notice: Subject to any disclaimer, the term of this patent is extended or adjusted under 35 U.S.C. 154(b) by 316 days.

(21) Appl. No.: 15/121,026

(22) PCT Filed: Feb. 23, 2015

(86) PCT No.: PCT/EP2015/053752

§ 371 (c)(1),
(2) Date: Aug. 23, 2016

(87) PCT Pub. No.: WO2015/128296

PCT Pub. Date: Sep. 3, 2015

(65) Prior Publication Data

US 2017/0008013 A1 Jan. 12, 2017

(30) Foreign Application Priority Data

Feb. 25, 2014 (DE) ..... 10 2014 102 472

(51) Int. Cl.
*B04B 9/12* (2006.01)
*B04B 9/14* (2006.01)

(52) U.S. Cl.
CPC . *B04B 9/12* (2013.01); *B04B 9/14* (2013.01)

(58) Field of Classification Search
CPC ..... B04B 9/12; B04B 9/14
(Continued)

(56) References Cited

U.S. PATENT DOCUMENTS 380,555 A * 4/1888 Downs ..... B04B 9/12 384/199
386,788 A * 7/1888 Roberts ..... B04B 9/12 384/194

(Continued)

FOREIGN PATENT DOCUMENTS

BE 513847 9/1952
CN 1214109 4/1999

(Continued)

OTHER PUBLICATIONS

STS Schwingungstechnik Schuster GMBH, Rubber Buffers Tailored Vibration Damping, 2013, pp. 1-6, Germany.

(Continued)

*Primary Examiner* — Charles Cooley
(74) *Attorney, Agent, or Firm* — Woodling, Krost and Rust

(57) ABSTRACT

A centrifuge (10), in particular a laboratory centrifuge, comprising a rotor (12) for receiving containers with material to be centrifuged, a drive shaft (14) on which the rotor (12) is supported, a motor (18) which drives the rotor (12) via the drive shaft, a bearing unit (30) with damping elements (36) each having a spring axis (36*a*), and a support element (54) for fixing the motor (18) in the centrifuge via the bearing unit (30), wherein the spring axes (36*a*) of the damping elements (36) are placed at an acute angle σ to the rotational axis Y of the motor (18). The invention is characterized in that the bearing unit (30) comprises a plurality of struts (34), preferably 3 to 21, which are connected to the damping elements (36), wherein the struts (34) are placed (Continued)

and arranged so that they are concentrically aligned with the respective spring axis.

11 Claims, 4 Drawing Sheets

(58) Field of Classification Search
USPC ..... 494/82
See application file for complete search history.

(56) References Cited

U.S. PATENT DOCUMENTS

| | | | | | |
|---|---|---|---|---|---|
| 1,094,589 | A * | 4/1914 | Poland | B04B 9/12 | 210/365 |
| 1,174,955 | A * | 3/1916 | Balzer | B04B 9/12 | 310/157 |
| 1,554,299 | A * | 9/1925 | Seibel | B04B 9/12 | 310/157 |
| 1,794,402 | A * | 3/1931 | Mathias | B04B 9/12 | 248/638 |
| 1,815,934 | A * | 7/1931 | Stephens | B04B 9/12 | 210/364 |
| 1,848,641 | A * | 3/1932 | Meyer | B04B 9/12 | 210/241 |
| 2,487,343 | A * | 11/1949 | Kopf | B04B 9/12 | 384/535 |
| 2,969,172 | A * | 1/1961 | Hutt | D06F 37/24 | 192/3.61 |
| 3,003,831 | A * | 10/1961 | King | B60K 17/24 | 180/381 |
| 3,363,772 | A * | 1/1968 | Jarvis | B04B 9/12 | 210/363 |
| 3,692,236 | A * | 9/1972 | Livshitz | B04B 9/14 | 494/20 |
| 4,079,882 | A * | 3/1978 | Mizuyoshi | B04B 5/0421 | 248/638 |
| 5,667,202 | A | 9/1997 | Gwinn | | |
| 5,800,070 | A * | 9/1998 | Nilsson | B04B 9/12 | 384/535 |
| 6,338,708 | B1 * | 1/2002 | Miura | B04B 9/12 | 494/82 |
| 6,354,988 | B1 * | 3/2002 | Carson | B04B 9/12 | 464/180 |
| 2015/0209803 | A1 * | 7/2015 | Mackel | B04B 7/02 | 494/83 |
| 2017/0008013 | A1 * | 1/2017 | Eberle | B04B 9/12 | |
| 2017/0328804 | A1 * | 11/2017 | Eberle | B04B 9/12 | |

FOREIGN PATENT DOCUMENTS

| | | | | |
|---|---|---|---|---|
| DE | 692527 | | 5/1940 | |
| DE | 1101600 | | 3/1961 | |
| DE | 3922744 | | 1/1991 | |
| DE | 19516904 | | 11/1996 | |
| GB | 739666 | | 11/1955 | |
| GB | 2234319 | A * | 1/1991 | B04B 9/12 |
| JP | 63-201650 | * | 12/1988 | |
| JP | S63-201650 | | 12/1988 | |
| JP | 64-1750 | * | 1/1989 | |
| JP | S64-1750 | | 1/1989 | |

OTHER PUBLICATIONS

German Patent and Trademark Office, Search Report, dated Nov. 18, 2014, pp. 1-10, German Application No. 102014102472.9.
European Patent Office, International Search Report, dated Jun. 22, 2015, pp. 1-9, International Application No. PCT/EP2015/053752.
State Intellectual Property Office of China, Office Action, dated Dec. 22, 2017, pp. 1-4.
Japan Patent Office, Office Action, dated Nov. 9, 2017, pp. 1-11, Patent Application No. 2016-551245.
Japan Patent Office, Translation of the Office Action, dated Nov. 9, 2017, pp. 1-15, Patent Application No. 2016-551245.

* cited by examiner

CENTRIFUGE WITH DAMPING ELEMENTS

This patent application is the national phase entry of PCT/EP2015/053752. PCT/EP2015/053752, international application filing date Feb. 23, 2015, claims the benefit and priority of and to German patent application no. DE 10 2014 102 472.9, filed Feb. 25, 2014. German patent application no. 10 2014 102 472.9, filed Feb. 25, 2014, is incorporated herein by reference hereto in its entirety.

BACKGROUND OF THE INVENTION

Field of the Invention

The invention relates to a centrifuge.

Description of the Related Art

Generic centrifuges are known and come in a large variety of different designs. In particular for laboratory centrifuges, the aim has always been to propose devices of an as compact as possible design since space is often limited in laboratories. In addition, laboratory centrifuges are typically loaded and unloaded from the top, for which reason sufficient space must be provided above each device to ensure its lid can be opened.

At the same time, when designing a centrifuge, care must be taken to ensure good damping so as to counteract any imbalances which will invariably arise. For this purpose, it is generally known for example to support the motor in damping elements whose spring axes extend in parallel to the longitudinal axis of the motor. However, the known arrangement and damping approaches have frequently proved insufficient in practice. Firstly, in the previous arrangement of damping elements, the forces generated will be only absorbed inadequately. Secondly, the damping elements will be exposed to strain in a way which will shorten their service life.

SUMMARY OF THE INVENTION

It is the object of the present invention to create a centrifuge, in particular a laboratory centrifuge, which will avoid the above mentioned shortcomings and which is supported in such a way that its damping elements will be optimally strained and improved damping is thus achieved.

The invention is based on the finding that in the event of an imbalance, the rotor will not perform a tilting motion but rather a tumbling motion. So far, owing to the upward and downward rotor movements observed in operation, one has so far assumed that the rotor performs an up and down movement. In fact, however, the forces arising do not act in parallel to the axis of rotation. Rather, there are forces at play whose vectors are inclined with respect to the axis of rotation. By changing the position of the damping elements with respect to the rotor support and/or the motor, the invention now makes it possible to obtain more efficient damping and to stabilize the centrifuge as a whole.

According to the invention, the centrifuge has a rotor for receiving containers holding material to be centrifuged, a drive shaft on which the rotor is supported, a motor which drives the rotor via the drive shaft, a bearing unit with damping element each having a spring axis, and a support element for fixing the motor in the centrifuge via the bearing unit. The spring axes of the damping elements are placed at an acute angle σ to the rotational axis of the motor. Since forces generated as a result of vibrations caused by the rotation of the rotor, in particular in the event of imbalances, also act at an acute angle to the rotational axis of the motor, this alignment of the damping elements is advantageous in that the forces acting on the damping elements will then mainly be tension and pressure forces. Forces which are a higher strain on the damping elements and thus result in faster wear and tear, such a shearing forces, will be minimized or eliminated completely by this arrangement. Consequently, the service life of the damping elements can be noticeably increased in a simple manner and damping can be considerably improved.

In a preferred embodiment, the bearing unit comprises a plurality of struts, preferably between 3 and 21 struts, which are connected to the damping elements and which are positioned and arranged so as to be concentrically aligned with the respective spring axis. The enlarged diameter on the underside of the bearing unit results in higher stability and thus an improved dampening effect for the rotor.

According to one aspect of the invention, the bearing unit comprises an upper support plate which is firmly connected to the motor and a lower support plate which is firmly connected to the support element. This reinforces the bearing unit which will thus be capable of more effectively absorbing and distributing forces from the centrifuge.

It is considered advantageous for angle σ to be between 10° and 42° since experience has shown that the forces to be absorbed which are created at the centrifuge as a result of imbalances will act at an angle of this range relative to the rotational axis of the motor. So a major part of these forces can be directed into the damping elements as tension or pressure forces, and shearing and bending forces will be considerably reduced. This will additionally reduce any detrimental strain on the damping elements and thus increase their service life.

It is particularly advantageous for angle σ to be of between 15° and 25° because—as various simulations have shown—in particular with laboratory centrifuges, the forces coming from the centrifuge will usually act at an angle whose value is within this range. This will reduce to a minimum any shearing and bending forces which may be detrimental to the service life of the damping elements.

In an advantageous embodiment, the damping elements are arranged between the struts and the lower support plate. The increased spacing of the damping elements and the enlarged diameter will change the lever ratios in the bearing unit in such a way that an improved dampening effect will be achieved.

Basically any devices which are capable of damping vibrations can be used as damping elements, for example spring bearings, hydraulic bearings or magnetic bearings. In particular, however, the use of rubber-metal elements as damping elements has proven to be advantageous as these are space-saving and inexpensive.

In a preferred embodiment, the upper support plate and the struts are interconnected via first spring elements. This will cause part of the forces from the centrifuge to be absorbed by the spring elements and owing to the even distribution of the spring elements across the circumference of the upper support plate to be evenly distributed to them. This will clearly improve the dampening effect of the bearing element.

In an advantageous embodiment of the invention, the lower support plate and the damping elements are interconnected via second spring elements. In this case, too, part of the forces coming from the centrifuge will be absorbed by the second spring elements, and owing to the uniform distribution of the spring elements across the circumference of the lower support plate, the forces will also be evenly distributed to them. This will again improve the dampening effect of the bearing element.

If, moreover, the mass element is connected to the struts through third spring elements, the mass element may in turn stabilize the damping elements through its mass, and, on the other hand, similar to the upper and lower support plate, absorb horizontal forces and amplitude oscillations and transfer them from strut to strut. This will further increase the rigidity of the bearing element and thus further improve the dampening of the system.

It is considered advantageous for the mass element to comprise two disk-shaped mass plates and a fixation plate provided in-between. The disk-shaped design ensures optimum mass distribution and low space requirement. The physical separation of mass plates and fixation plate results in a simpler design as the struts will only have to be connected to the comparatively thin fixation plate.

In a preferred embodiment of the invention, the first, second and/or third spring elements are provided in the form of tabs which project from the associated plate, such as the upper support plate, the lower support plate and/or the fixation plate, and can be moved elastically. This simplifies the connection of plates and struts and/or damping elements. In particular, it facilitates the fitting of the bearing unit.

It is advantageous for the tabs and the associated plates to be made of metal. For their production, one can thus choose from a multitude of metals and alloys, and the respective structural requirements of the centrifuge can be met satisfactorily.

It is considered particularly advantageous for the upper support plate, the lower support plate and/or the fixation plate to be in the form of a ring disk. Ring disks can be easily manufactured, and the struts and/or damping elements can be easily distributed evenly on their circumference. This results in a good distribution of the forces redirected to the respective plates by the tabs. The bearing element will thus exhibit increased stability and damping power.

In one aspect of the invention, at least one of the upper and lower support plates and the fixation plate is integrally formed with its associated tabs and in particular made of metal, preferably of sheet steel. This makes the production of the bearing element easier and cheaper since it has considerably fewer components. The tabs can be produced together with the support plate in a punching and bending process. Furthermore, integrally forming the plate and the tabs will result in improved stability of the bearing element.

With a view to further increasing the stability of the system, the motor may have mounting feet which project from the motor housing, are arranged around the motor housing evenly spaced from each other and firmly connect the motor to the bearing unit.

In a preferred embodiment of the invention, the mounting feet connect the motor to the upper support plate, with tabs of the upper support plate being provided between the mounting feet. This will reliably connect the motor to the bearing unit, evenly distribute the acting forces across the upper support plate and ensure a compact centrifuge design.

Additional advantages, features and possible applications of the present invention may be gathered from the description which follows, in which reference is made to the embodiments illustrated in the drawings. In the drawings,

DESCRIPTION OF THE INVENTION

Figure 1:
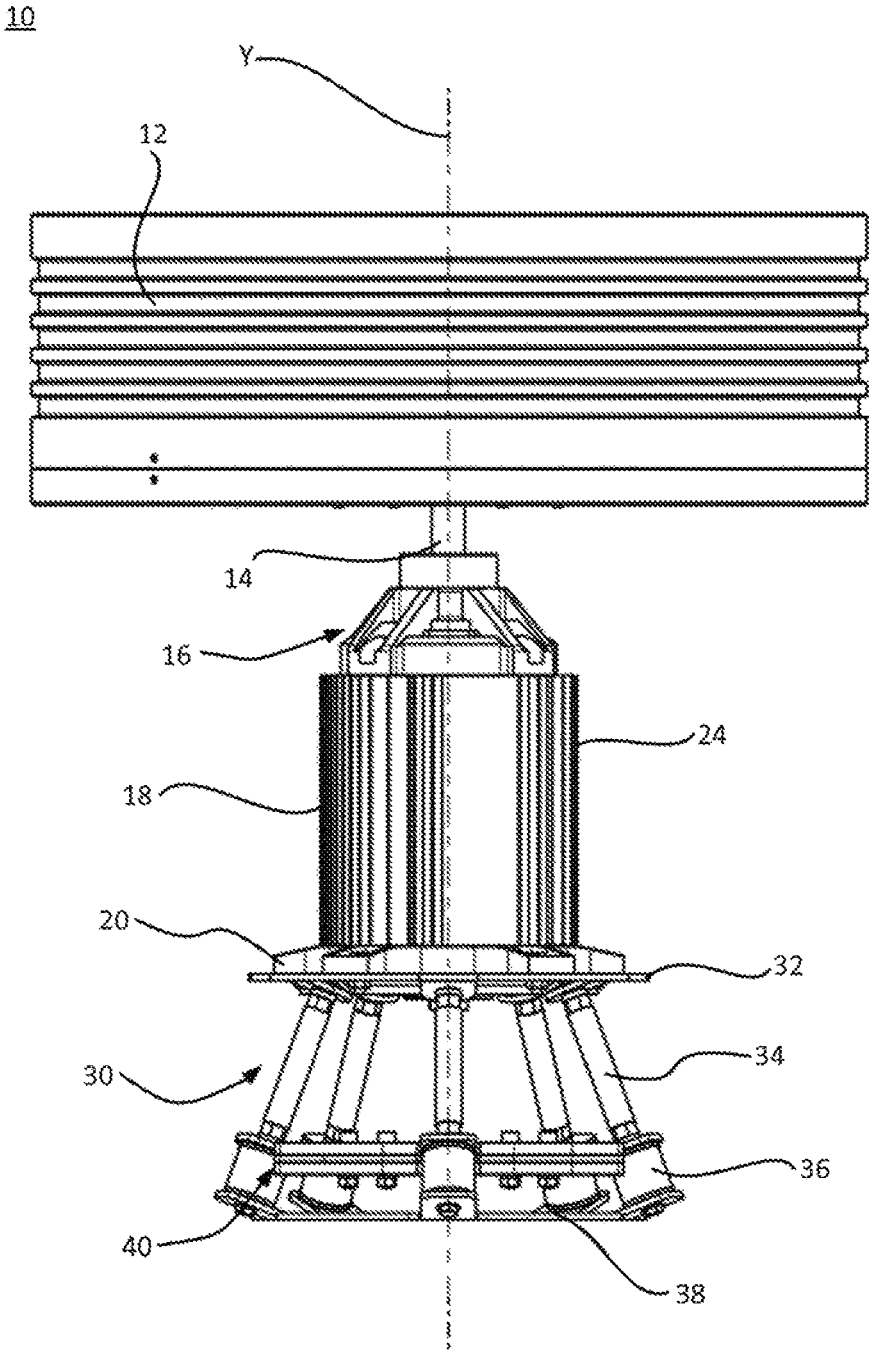
FIG. 1 is a lateral view of the centrifuge without its housing.

FIG. 1 is a lateral view of a laboratory centrifuge 10. For a better view of the elements that are essential to the invention, the centrifuge housing has been omitted from this figure and the other drawings.

Mounted at the top end of and along a longitudinal and rotational axis Y of a motor 18, which axis is also the rotational axis of the centrifuge 10, is a rotor 12 for receiving containers holding material to be centrifuged. The rotor 12 is supported on a motor shaft 14 which is driven by the motor 18 located under it. The motor 18 is surrounded by a motor housing 24. The motor shaft 14 is rotatably mounted in the motor housing 24 via an upper bearing 16 and, on the side facing the bearing, a lower bearing 22 which encases the motor shaft 14, see FIG. 5. In a known manner, the motor shaft 14 is connected to rotate with the rotor 12, for example by means of a spline shaft (not shown here).

On the side of the motor 18 facing away from the rotor 12, the motor housing 24 is provided with evenly spaced mounting feet 20 which firmly connect the motor 18 to an upper support plate 32 of a bearing unit 30. The bearing unit 30 is intended to support the motor 18 as well as to dampen forces caused by rotation of the rotor 12.

On the side of the bearing unit 30 facing away from the motor 18 there is a lower support plate 38. Mounted on the lower support plate 38 are inclined rubber-metal elements 36 which are to serve as damping elements and which are in turn firmly connected to the upper support plate 32 via struts 34 mounted at the same angle. With respect to the longitudinal axis Y, for the angle of attack a of the rubber-metal elements 36 and associated struts 34, angles between 10° and 42° are generally considered advantageous since the forces generated as a result of imbalances will act in this range of angles during rotation of the rotor 12. For the present embodiment of the centrifuge 10, an angle of attack a of 21° has proven particularly suitable.

It is furthermore conceivable to implement the bearing unit 30 without the struts 34, for example, and to mount the rubber-metal elements 36 directly on the upper support plate 32. However, it has shown that the larger diameter on the underside of the bearing unit 30 will result in higher stability and thus an improved dampening effect. Otherwise, spring bearings, magnetic bearings or hydraulic bearings can also be used, for example. However, the cost/benefit ratio of the rubber-metal elements 36 chosen for this centrifuge 10 is particularly favourable.

Lastly, a mass element 40 is provided between the upper support plate 32 and the lower support plate 38, which element 40 is firmly connected to the struts 34 and the rubber-metal elements 36. The inclined position of the rubber-metal elements 36 and the spacing of the rubber-metal elements 36 from the motor 18 by means of the struts 34 already result in a good dampening effect so that there is no absolute need for the mass element 40. However, adding a mass element 40 will clearly improve the dampening effect even more.

The connections between the elements discussed so far will now be described below with reference to FIG. 2 and FIG. 5.

Figure 2:
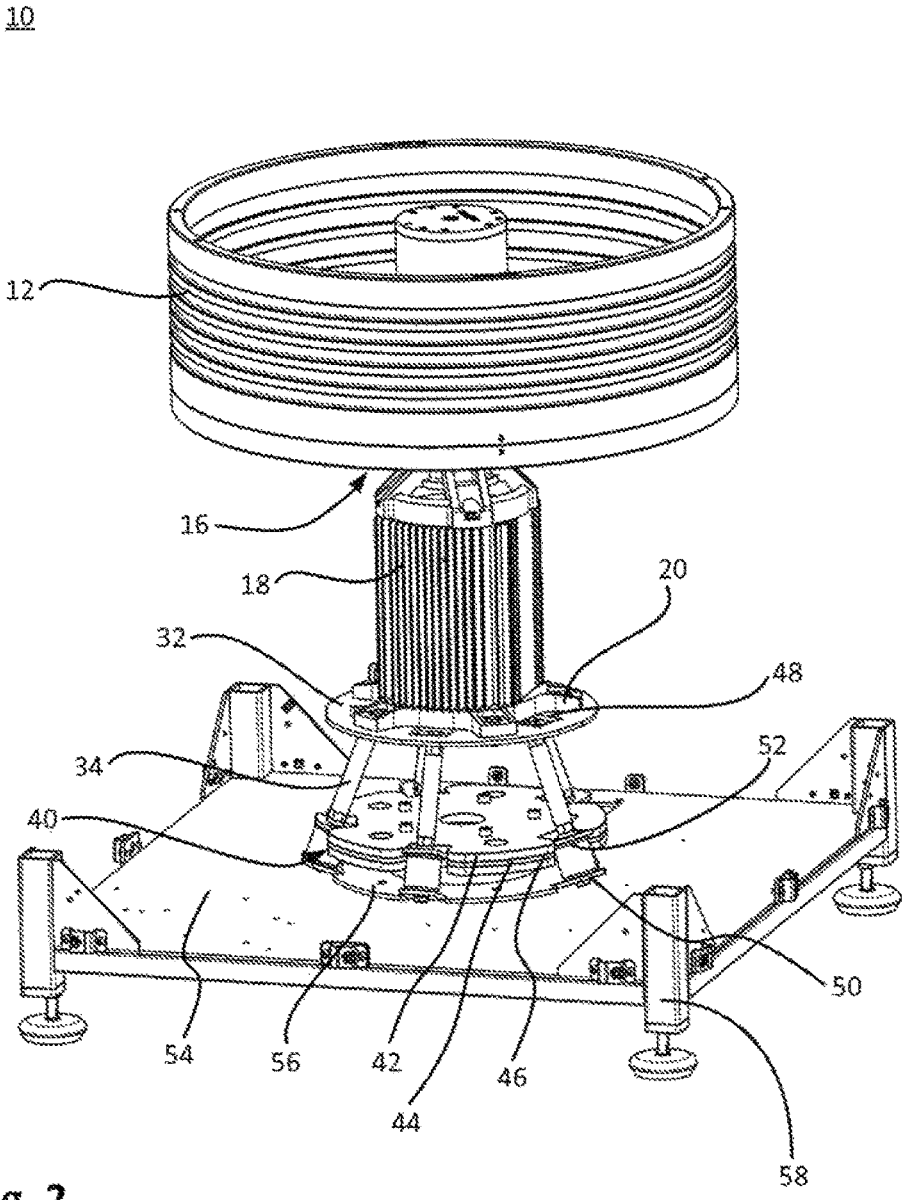
FIG. 2 is a perspective view of the centrifuge with a support element, without its housing.

FIG. 2 is a perspective view of the centrifuge 10 which is shown to be mounted on a support element 54 here. On the upper support plate 32, a first elastic tab 48 can be seen between each pair of mounting feet 20. Said tab 48 receives the respective end of a strut 34 which faces the upper support plate 32, and elastically connects the respective strut 34 to the upper support plate 32. The first elastic tabs 48 may also be separate components which are for example welded onto the upper support plate 32. However, the stability of the bearing unit 30 will be increased if the first elastic tabs 48, as in the illustrated embodiment, are integrally formed with the upper support plate 32, for example by means of a punching and bending process, and are also made of the same material as the upper support plate 32.

The lower boundary of the support element 30 is formed by a lower support plate 38 which is connected to the rubber-metal elements 36 via second elastic tabs 50. Positioned between the lower support plate 38 and the upper support plate 32 is the mass element 40. The mass element 40 consists of three plates which are stacked on top of each other. At the centre is a fixation plate 44 which is elastically connected to the rubber-metal elements 36 and the struts 34 via third elastic tabs 52. Mounted above and below said fixation plate 44 are a disk-shaped upper mass plate 42 and a disk-shaped lower mass plate 46, respectively, which are both securely connected to the fixation plate 44. Similarly to the first elastic tabs 48, the second elastic tabs 50 and the third elastic tabs 52 of this embodiment are also integrally formed with the respective associated lower support plate 38 and the fixation plate 44, respectively, and are made of the same material as the respective associated plate.

The bearing unit is firmly connected to the support element 54 via the lower support plate 38 by means of screw connections 56. At its four corners, the support element 54 has supporting legs 58 via which the centrifuge 10 stands on the underlying surface.

Figure 3:
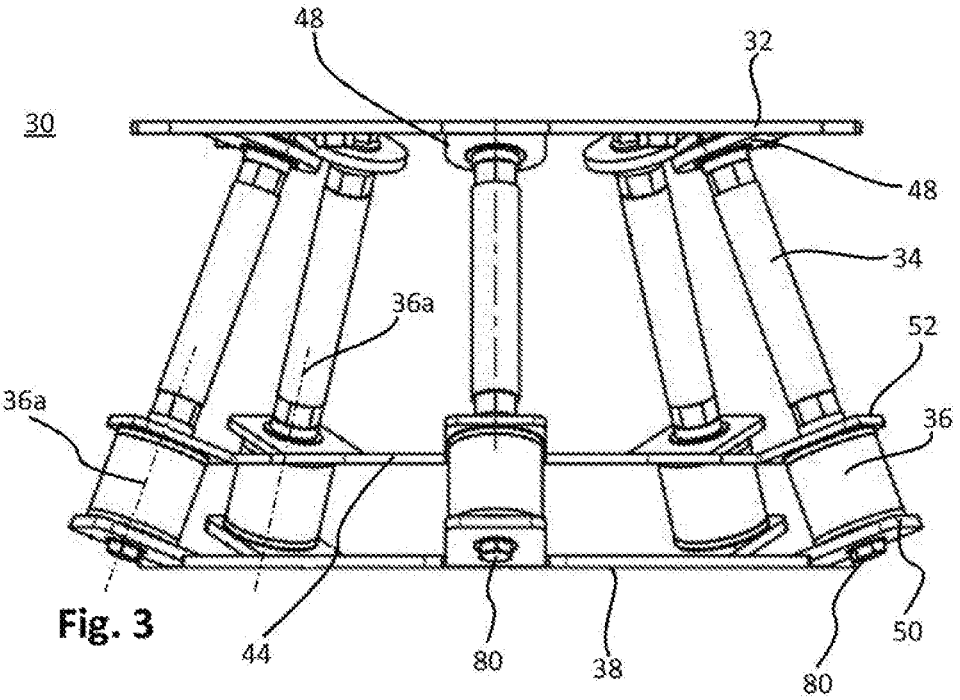
FIG. 3 is a lateral view of the bearing unit.

The dampening effect of the bearing unit 30 will now be explained with reference to FIG. 3 which is a lateral view of the bearing unit 30. For reasons of clarity, the two mass plates 42 and 46 of the mass element 40 have been omitted from this view.

As described above, forces from the rotating parts of the centrifuge 10, for example resulting from imbalances, act at an acute angle with respect to the axis of rotation Y. Simulations have shown that this angle is between 10° and 21° for the centrifuge of the present invention. In order to absorb these forces as effectively as possible and to avoid as much strain on the damping elements as possible, the rubber-metal elements 36, which perform most of the dampening action, are positioned at a suitable angle of attack a of 21°. The rubber-metal elements 36 are firmly connected to the lower support element 38 via the second elastic tabs 50. In this case, the second elastic tabs 50 serve as spring elements and thus increase the dampening effect of the bearing unit 30.

In another embodiment of the centrifuge 10, the rubber-metal elements 36 may for example also be mounted directly on the upper support plate 32, for example. However, in order to obtain a larger diameter on the underside of the bearing unit and thus achieve higher stability and an improved dampening effect at that, the rubber-metal elements 36 of the present embodiment are spaced from the upper support plate 32 by the struts 34. In addition, for stabilising the bearing element 30, the mass element 40 (which in FIG. 3 is only represented by the fixation plate 44) is provided between the rubber-metal elements 36 and the struts 34. The first elastic tabs 48 formed in the upper support plate 32 and which securely connect the struts 34 to the upper support plate 32, and the third elastic tabs 52 formed in the fixation plate 44 and which securely connect the fixation plate 44 to the struts 34 and the rubber-metal elements 36, act as spring elements—like the second elastic tabs 50—and thus further increase the dampening effect of the bearing unit 30. Here, it is in particular the third elastic tabs 52 which introduce part of the forces to be absorbed into a horizontal plane between the struts 34, i.e. into the mass element 40.

Figure 4:
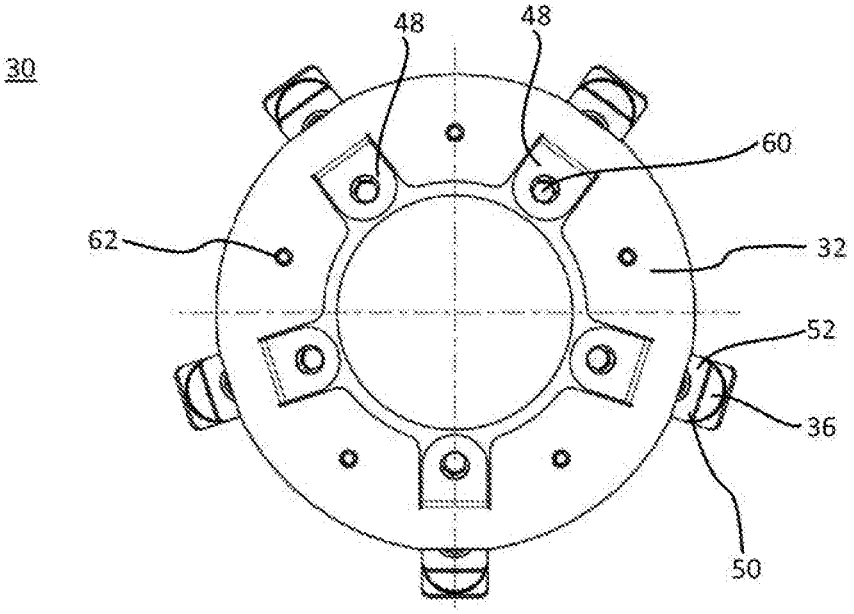
FIG. 4 is a top view of the bearing unit.

FIG. 4 is a top view of the bearing element 30. The five struts 34 which cannot be clearly seen from this perspective have been screwed to the first elastic tabs 48 by means of hexagon bolts 60. However, the number of struts 34 can also be varied depending on the respective requirements. Furthermore, the upper support plate 32 has five bores 62 for screwing the mounting feet 20 of the motor 18 onto the upper support plate 32. This is illustrated in FIG. 5.

Figure 5:
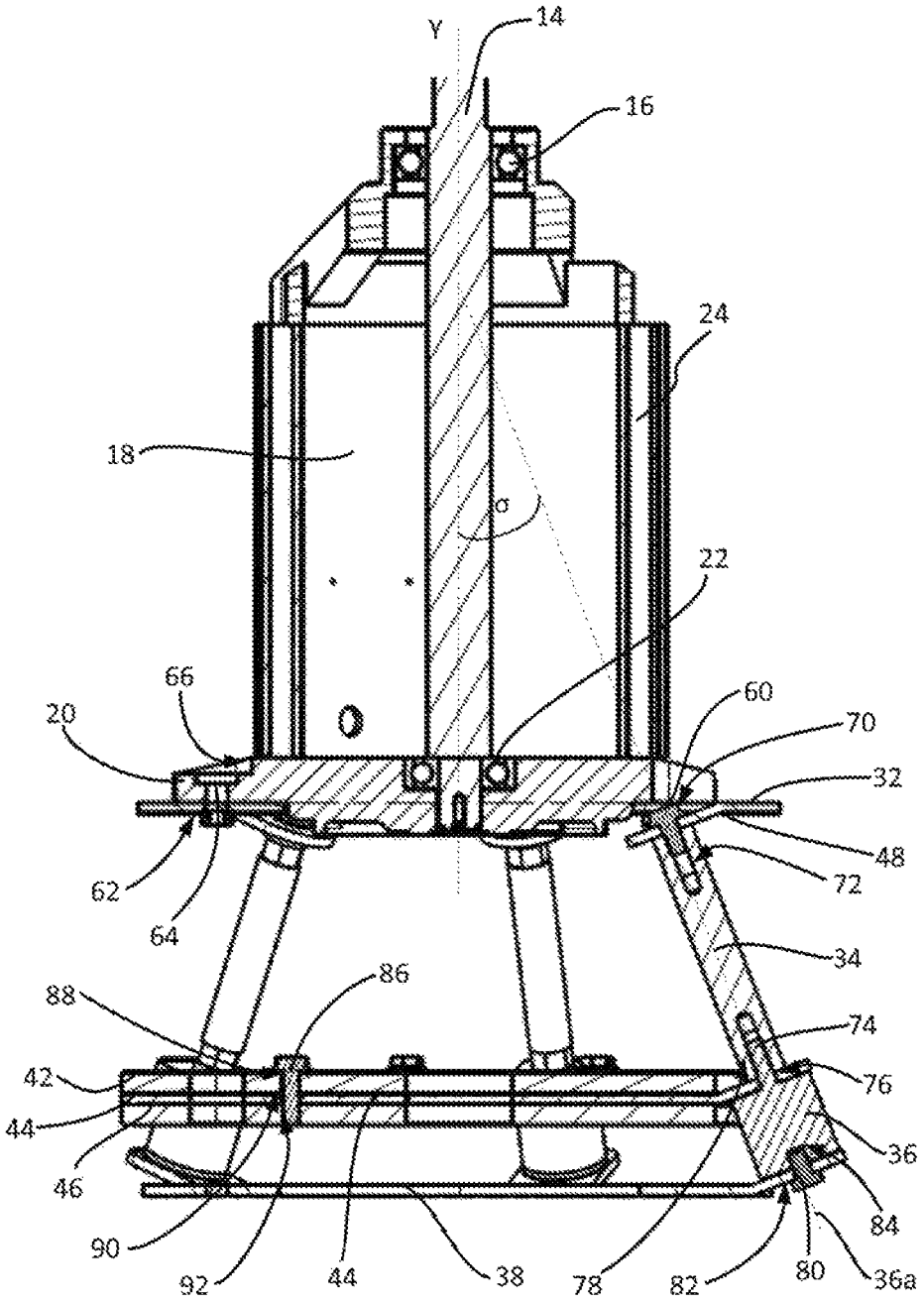
FIG. 5 is a vertical view of the centrifuge in cross-section, without the rotor and the housing.

FIG. 5 is a schematic view of the centrifuge 10 in vertical cross-section. In contrast to FIG. 1, the rotor 12 and the two struts 34 have been omitted from this view, for reasons of clarity. This sectional view more clearly illustrates individual connections.

The mounting feet 20 of the motor 18 are screwed onto the upper support plate 32 via nut-and-bolt connections 64. For this purpose, bores 66 are provided in the mounting feet 20 and bores 62 are provided in the upper support plate 32, which bores are assigned to each other.

The secure connection of the upper support plate 32 and the struts 34 is accomplished by passing the hexagon bolts 60 through bores 70 in the first elastic tabs 48 and bores 72—which bores are assigned to each other—and then screwing them into the ends of the struts 34 which face the upper support plate 32.

The secure connection of the fixation plate 44 to the struts 34 and the rubber-metal elements 36 is obtained by passing a pin 74 each provided on the side of the rubber-metal elements 36 facing the motor 18 through an assigned bore 76 in the third elastic tab 52 where said pin 74 then enters an assigned bore 78 in the strut 34. The weight of the centrifuge 10 and the inclined position of the struts 34 and the rubber-metal elements 36 makes the form-locking connection between the pin 74 and the bores 76 and 78 sufficiently stable.

The secure connection of the rubber-metal elements 36 to the lower support plate 38 is accomplished by screwing bolts 80 through bores 82 in the second elastic tabs 50 and bores 84 in the rubber-metal elements 36, which bores are assigned to each other.

A reliable connection of the fixation plate 44, the upper mass plate 42 and the lower mass plate 46 is obtained by means of nut- and bolt connections 86, in which a bolt each is passed through a bore 88 provided in the upper mass plate 42, a bore 90 provided in the fixation plate 44 and a bore 92 provided in the lower mass plate 46 and then fixed in position using the associated nut.

LIST OF REFERENCE SIGNS

10 centrifuge
12 rotor
14 motor shaft
16 bearing
18 motor
20 mounting feet
22 lower bearing
24 motor housing

30 bearing unit
32 upper support plate
34 struts
36 rubber-metal elements
36*a* spring axis
38 lower support plate
40 mass element
42 upper mass plate
44 fixation plate
46 lower mass plate
48 first elastic tabs
50 second elastic tabs
52 third elastic tabs
54 support element
56 screwed connections
58 support legs
60 hexagon bolts
62 bores
64 nut-and-bolt connections
66 bores
70 bores
72 bores
74 pins
76 bores
78 bores
80 screws/bolts
82 bores
84 bores
86 nut-and-bolt connections
88 bores
90 bores
92 bores

What is claimed is:

1. A centrifuge (10), comprising:
a rotor (12) for receiving containers with material to be centrifuged;
a drive shaft (14);
said rotor 12 is supported on said drive shaft;
a motor (18) drives said drive shaft (14),
said motor includes a rotational axis Y and a motor housing;
a bearing unit (30) with damping elements (36);
each damping element has a spring axis (36*a*);
a support element (54) for securing said motor (18) in said centrifuge via said bearing unit (30);
said spring axes (36*a*) of said damping elements (36) are placed at an acute angle σ to said rotational axis Y of said motor (18);
said bearing unit (30) comprises a plurality of struts (34);
each of said plurality of struts is connected to a respective one of said damping elements (36);
each of said struts (34) being positioned and arranged such that they are concentrically aligned with a respective one of said respective spring axis;
said motor (18) includes mounting feet (20) projecting from said motor housing (24); and,
said mounting feet (20) being mounted around said motor housing (24) uniformly spaced from each other and connecting said motor (18) to said bearing unit (30).

2. The centrifuge as claimed in claim 1, further comprising:
said motor (18) is connected to an upper support plate (32);
said upper support plate (32) includes tabs (48); and,
said tabs (48) of said upper support plate (32) reside between said mounting feet (20).

3. A centrifuge (10), comprising
a rotor (12) for receiving containers with material to be centrifuged;
a drive shaft (14);
said rotor (12) is supported on said drive shaft;
a motor (18) drives said drive shaft (14),
said motor includes a rotational axis Y;
a bearing unit (30) with damping elements (36);
a first spring element (48) and a second spring element (50);
each said damping element has a spring axis (36*a*);
a support element (54) for securing said motor (18) in said centrifuge via said bearing unit (30);
said spring axes (36*a*) of said damping elements (36) are placed at an acute angle σ to said rotational axis Y of said motor (18);
said bearing unit (30) comprises a plurality of struts (34), an upper support plate, a lower support plate, and a fixation plate (44);
said upper support plate cooperating with said first spring element (48) and said lower support plate cooperating with said second spring element (50);
said plurality of struts number between 3 and 21 struts;
each of said plurality of struts is connected to a respective one of said damping elements (36) through said fixation plate;
each of said struts (34) being positioned and arranged such that they are concentrically aligned with a respective one of said respective spring axis;
said upper support plate (32) connected to said motor (18);
said lower support plate (38) connected to said support element (54);
said upper support plate (32) and said struts (34) are connected to each other by said first spring elements (48);
said fixation plate (38) and said struts (34) are connected to each other by said second spring elements (50); and,
each said damping element resides between said lower support plate and said fixation plate.

4. The centrifuge as claimed in claim 3, further comprising:
said angle σ is in the range of between 10° and 42°.

5. The centrifuge as claimed in claim 3, further comprising:
each of said damping elements (36) is disposed between one of said struts (34) and said lower support plate (38).

6. The centrifuge as claimed in claim 3, further comprising:
said damping elements (36) are selected from the group consisting of spring bearings, hydraulic bearings, magnetic bearings, and rubber-metal elements.

7. A centrifuge (10), comprising:
a rotor (12) for receiving containers with material to be centrifuged;
a drive shaft (14);
said rotor (12) is supported on said drive shaft;
a motor (18) drives said drive shaft (14),
said motor includes a rotational axis Y;
a bearing unit (30) with damping elements (36);
each damping element has a spring axis (36*a*);
a support element (54) for securing said motor (18) in said centrifuge via said bearing unit (30);
said spring axes (36*a*) of said damping elements (36) are placed at an acute angle σ to said rotational axis Y of said motor (18);

said bearing unit (30) comprises a plurality of struts (34);

each of said plurality of struts is connected to a respective one of said damping elements (36);

each of said struts (34) being positioned and arranged such that they are concentrically aligned with a respective one of said respective spring axis;

a first spring element, a second spring element and a third spring element;

said bearing unit (30) includes: an upper support plate (32) which includes said first spring element, and, a lower support plate (38) which includes said second spring element;

a mass element (40) is affixed to a fixation plate, said fixation plate (44) is affixed to said struts and to said damping elements (36);

said mass element (40) comprises two disk-shaped mass plates (42, 46) and said fixation plate (44) disposed therebetween.

8. The centrifuge as claimed in claim 7, further comprising:

said first spring element, said second spring element and said third spring element are tabs projecting from said upper support plate (32), said lower support plate (38) and said fixation plate (44), respectively, and said first spring element, said second spring element and said third spring element extend perpendicularly to said spring axis (36*a*) and are elastically movable.

9. The centrifuge as claimed in claim 8, further comprising:

each of said tabs (48, 50, 52) and each of said plates (32, 38, 44) are made of metal.

10. The centrifuge as claimed in claim 8, further comprising:

at least one plate (32, 38, 44) of said upper support plate (32), said lower support plate (38) and said fixation plate (44) is integrally formed with said tabs (48, 50, 52) and is made of metal.

11. The centrifuge as claimed in claim 7, further comprising:

said upper support plate (32), said lower support plate (38) and said fixation plate (44) are ring disks.

* * * * *